US005586743A

United States Patent [19]

Sodolak

[11] Patent Number: 5,586,743

[45] Date of Patent: Dec. 24, 1996

[54] AUGER STAND

[76] Inventor: Eddie A. Sodolak, 144 Chew Rd., Sealy, Tex. 77474

[21] Appl. No.: 369,705

[22] Filed: Jan. 6, 1995

[51] Int. Cl.[6] ..... F16M 1/00

[52] U.S. Cl. ..... 248/671; 248/125.2; 248/127; 248/676

[58] Field of Search ..... 248/676, 125.2, 248/127, 132, 154, 231.85, 671, 670, 637

[56] References Cited

U.S. PATENT DOCUMENTS

| | | | |
|---|---|---|---|
| 987,180 | 3/1911 | Smith . | |
| 1,065,979 | 7/1913 | Spencer . | |
| 1,219,220 | 3/1917 | Banschbach | 248/676 |
| 1,424,190 | 8/1922 | Cole et al. | 248/676 X |
| 1,614,011 | 1/1927 | Martins | 248/127 |
| 1,932,951 | 10/1933 | Barieau | 224/29 |
| 2,195,955 | 4/1940 | Hillenbrand | 248/231.85 |
| 2,267,355 | 12/1941 | Van Riper | 248/125.2 |
| 2,459,080 | 1/1949 | Killius | 248/127 X |
| 2,602,615 | 7/1952 | Maynard et al. | 248/676 |
| 3,966,052 | 6/1976 | Knaus | 211/60 |
| 4,848,717 | 7/1989 | Bevill | 248/676 X |
| 4,880,122 | 11/1989 | Martindell | 211/70.6 |
| 4,998,698 | 3/1991 | Martinson | 248/176 |
| 5,014,961 | 5/1991 | Ferguson | 268/676 X |
| 5,117,854 | 6/1992 | Eve | 248/154 X |
| 5,257,764 | 11/1993 | Spaulding | 248/132 X |
| 5,326,068 | 7/1994 | Spears | 248/682 |

*Primary Examiner*—Ko Chan

*Attorney, Agent, or Firm*—Pravel, Hewitt, Kimball & Krieger

[57] ABSTRACT

An auger stand is provided which makes it possible to safely and quickly connect and disconnect the auger assembly to or from a tractor or other vehicle. The stand includes a coupling assembly having a support member and vertical members, each of which is fitted with a movable mount and a screw assembly. The auger stand facilitates mounting and dismounting the auger assembly from the vehicle.

26 Claims, 2 Drawing Sheets

AUGER STAND

BACKGROUND OF THE INVENTION

1. Field of the Invention

The invention relates to support stands for the use and storage of augers of the type used on farms, ranches, and construction sites.

2. Description of the Related Art

Augers have been widely used on farms, ranches and construction sites for a variety of purposes. One of the most common uses has been the drilling of post holes or bore holes. The augers have been mounted onto a transport vehicle, usually a tractor, through a connecting drive assembly which includes a drive shaft, one or more support arms (or, booms), a hub, and the auger blade (or, auger) itself. The connecting drive assembly and the auger has commonly been termed collectively as the auger assembly. The auger assembly has been connected to the tractor through some form of pin or lock connector mechanism. A typical auger assembly often weighs well over one hundred pounds. In size, it is about as large as an average male adult.

There are a number of situations where the tractor is needed for other purposes than auger power and transport service, requiring the relatively heavy auger be disconnected from the tractor. Later, it has been necessary to remount the heavy auger to the tractor. Because of its size and weight, quickly and safely mounting and dismounting the cumbersome and heavy auger assembly from a tractor has been a problem. It has been difficult to both support the auger assembly while at the same time attempting to connect the assembly to the tractor via a master pin connector. Currently, this is a task best safely done by two, if not three, people. There are, however, a number of times when there are not that number of people available.

BRIEF SUMMARY OF THE INVENTION

Briefly, the present invention provides a new and improved auger stand for supporting an auger which is connectable by a connector linkage and drive mechanism to a transport vehicle, such as a tractor. The auger which is supported by the auger stand of the present invention has an auger blade extending about an auger shaft below an auger drive hub. The auger stand of the present invention supports the auger during connection and disconnection of the auger from the vehicle. The auger stand of the present invention may also serve as an auger storage stand and be used as well during maintenance or repair of the auger.

The auger stand according to the present invention includes a support rack or frame and a support plate member mounted on the support rack for receiving and supporting the auger hub. The support plate member has a slot or channel formed in it for passage of the auger shaft and also for guiding the auger into place on the stand. An adjustably mountable load transfer support mechanism on the support rack is adapted to be located below the auger connector linkage to substantially transfer the weight of the auger assembly from the vehicle to the stand during auger connection and disconnection.

DETAILED DESCRIPTION OF THE PREFERRED EMBODIMENTS

Figure 2:
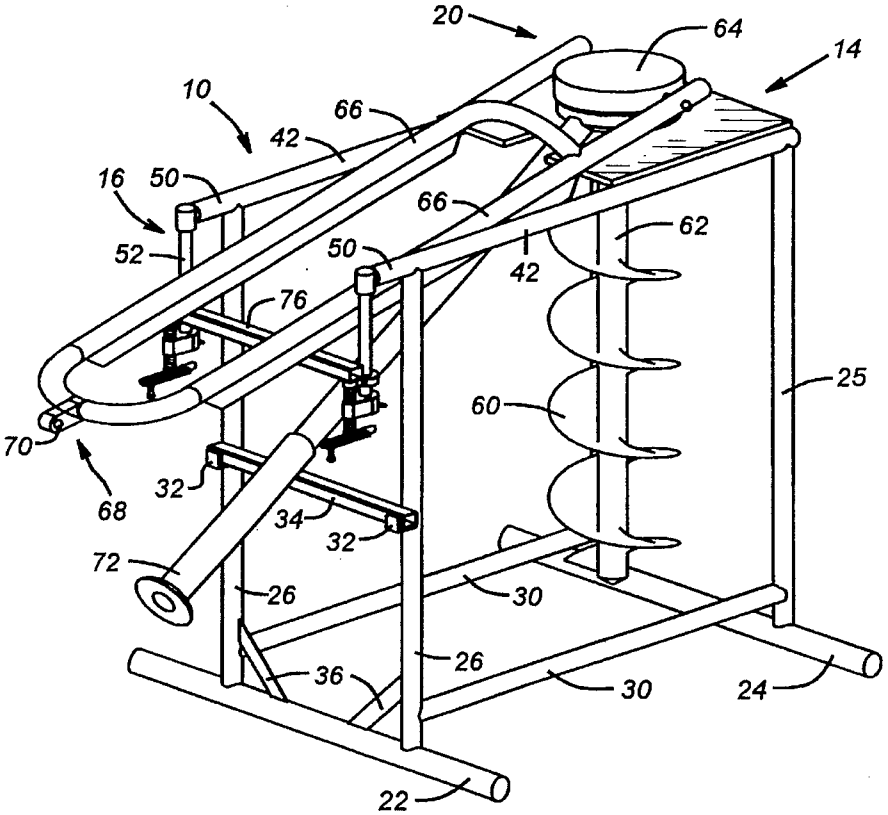
FIG. 2 is an isometric view of the auger stand of FIG. 1 with an auger assembly stored in it.

Referring to the figures, an auger stand 10 according to the present invention is shown. The auger stand 10 provides a simple, yet safe and convenient way to mount and dismount from a tractor or other vehicle the sizable heavy augers, such as those used on farms and ranches. The auger stand 10 (FIGS. 1 & 2), is shown in position ready to receive and support for storage, maintenance, repairs or other purposes an auger assembly 20 (FIG. 2). The auger stand 10 (FIGS. 1 & 2) comprises a support rack 12, a support plate member 14, and a coupling assembly or load transfer support 16.

The rack 12 serves as a support frame and is adapted for placement on a floor or other suitable surface where it is desired to mount, dismount, store or repair the auger assembly 20. The rack 12 has a support base 18 in the form of a pair of spaced transverse base rails or beams, and also including a front base beam 22 and a rear base beam 24. The front base beam 22 has mounted thereon a pair of upwardly extending front support beams or posts 26, while the rear base rail 24 has mounted thereon a pair of upwardly extending rear support beams or posts 28. A lower longitudinal support rod or bar 30 is mounted extending between the post 26 on front base beam 22 and the post 28 on the rear support beam 24 on each side of the rack 12.

An upwardly facing support bracket 32 is mounted extending forwardly at an appropriate height from each of the front support beams 26 to provide an attachment point and support for a transverse support beam 34 (FIG. 2) of the load transfer support mechanism 16. If desired, supporting brace members or struts, such as those shown at 36, may be used at appropriate locations in the rack 12.

Figure 1:
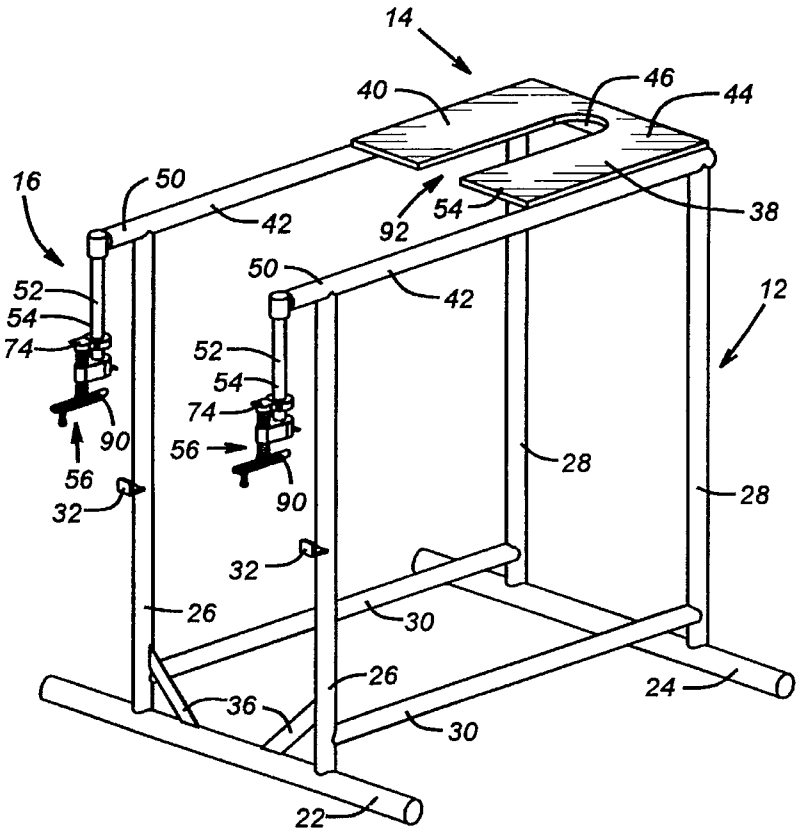
FIG. 1 is an isometric view of an auger stand of the present invention.
Figure 4:
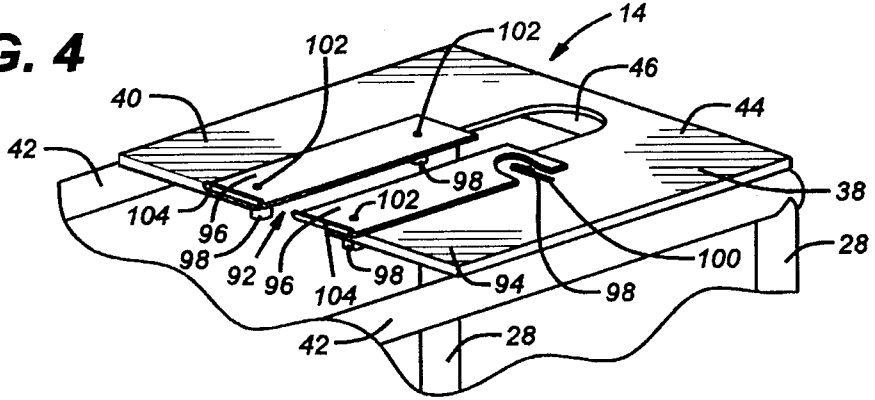
FIG. 4 is an enlarged isometric view, partly in cross-section, of a modified embodiment of auger stand of the present invention.

The support plate 14 is mounted along side portions 38 and 40 above a pair of longitudinal upper support rods 42. The support plate 14 is also mounted along a rear portion 44 above a transverse support rod 46 (FIGS. 1 & 4). The upper support rods 42 extend between upper ends of the front support posts 26 and rear support posts 28, interconnecting these members in addition to supporting the support plate 14. The transverse support rod 46 (FIG. 4) extends beneath the plate 14 at the rear of the auger stand 10 between the upper support rods 42 and also between the rear support poles 28.

Each of the longitudinal upper support rods 42 has a forward extension 50 extending from and beyond the front support beams 26. A downwardly extending connection member or rod 52 is mounted on the forward extension 50 to receive at its lower end 54 an elevating/lowering mechanism 56 of the coupling assembly 16.

Figure 3:
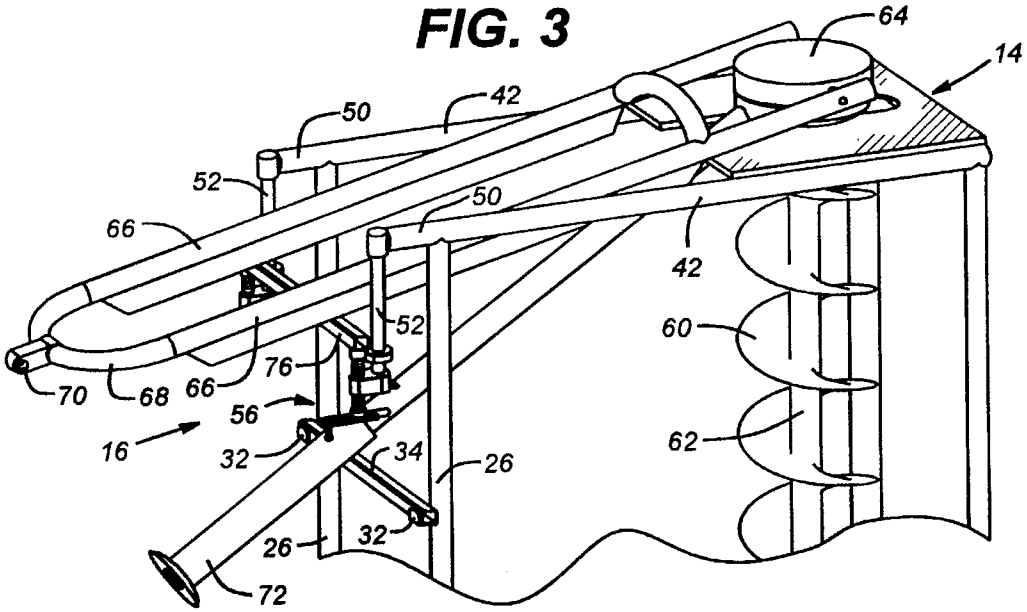
FIG. 3 is another isometric view of the auger stand of FIG. 2.

The auger assembly 20 may be of any suitable conventional type, as shown in FIG. 2 supported on the auger stand 10. Since the auger 20 is conventional, only those portions which interact with the auger stand 10 are described herein. The auger assembly 20 comprises an auger blade 60 (FIGS. 2 & 3) extending about an auger shaft 62 below an auger hub 64. The auger hub 64 is movably supported by a pair of boom arms or booms 66 on which is mounted a master pin connector linkage 68 having a pin or connector key slot 70 by which the auger 20 is connectable to a tractor or other transport vehicle. The auger hub 64 is also connectable by a drive shaft 72 in the conventional manner to a power take-off or drive mechanism on the tractor.

As has been set forth, a typical conventional auger assembly 20, even a relatively small one used on a farm tractor, frequently weighs over one hundred pounds. Unassisted mounting or dismounting of the auger assembly 20 has proven to be a difficult and sometimes dangerous operation for a single individual, particularly when the connections of linkage 68 and drive shaft 72 to the tractor are under load of the weight of the auger assembly 20.

Figure 5:
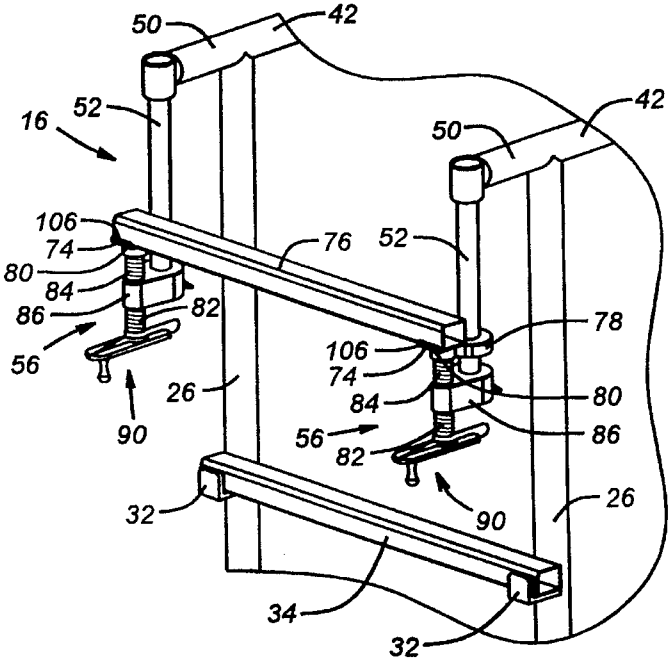
FIG. 5 is an enlarged isometric view of another portion of the auger stand of FIGS. 1, 2, and 3.

Considering the coupling assembly 16 (FIGS. 3 & 5) more in detail, a support plate or tab 74 is located on each of the mechanisms 56 to receive a laterally extending support member 76. The support member 76 functions as a rest and support for the boom arms 66 (FIG. 3) of the auger assembly 20. The mechanisms 56 adjust the position of the support 76 by raising or lowering it to a height where the load of the auger assembly 20 is transferred to the stand 10 from the connections 68 and 72 to the transport vehicle.

Each of the mechanisms 56 (FIGS. 3 & 5) includes a sleeve or collar 78 slidably movable in a vertical direction along one of the members 52. A journal lug 80 (FIG. 5) extends forwardly from each collar 78 to receive one of the support plates 74 for support 76. A position adjustment screw 82 is mounted for rotatable movement at an upper end 84 in each of the journal lugs 80.

Each of the position adjustment screws 82 passes at an intermediate portion through a sleeve 86 fixedly mounted at a lower end of one of the members 52. Each sleeve 86 has a threaded internal surface matched with the threads of adjustment screw 82 so that the screw 82 may advance or retract vertically as it is rotated.

A crank or handle 90 is mounted on each of the screws 82 at its lower end so that the screws 82 may be rotated to adjust the vertical position of the support 76 to receive a portion of the load of the auger assembly 20. The remainder of the load of the auger assembly 20 is borne by the support plate 14.

When a user may easily remove the master connector pin from slot 70, disengaging the auger assembly 20 from the tractor 20, the connection to the drive shaft 72 is also then removed. If desired, the support beam 34 may be inserted to support the drive shaft 72, or the drive shaft may rest on the ground.

The support plate 14 (FIGS. 1 & 4) of the auger stand 10 has a slot 92 formed extending inwardly into it from a front portion 94. The slot 92 permits passage of the auger shaft 62 into the support plate 14 so that the auger hub 64 may rest on the auger stand 10. The slot 92 further serves to guide the auger assembly 20 into proper position on the auger stand 10. The slot 92 may be of uniform width along its extent in the plate 14 rearwardly from the front portion 94 or it may be tapered in width along its rearward extent to assist in guiding the auger assembly 20.

The support plate 14 may also be fitted with a slot adjustment plate 96 (as shown in FIG. 4) movably mounted on one or both sides of slot 92. The plates 96 are releasably secured to the support plate 14 through securing screws 98, which fit in elongate holes or slots 100 in the support 14 and are received in openings 102 in the plates 96. The relative position of screws 98 in slots 100 establishes the relative position of plates 96 and thus adjust the width of the slot 92.

Each of the plates 96 is also preferably formed to have a stop lip 104 to assist in holding the auger hub 64 in place on the auger stand 10. When plates 96 are not included for slot adjustment, the front portion 94 of the support 14 may be constructed to include a stop lip like that shown at 104. Similarly, the support plates 74 may have stop lips 106 (FIG. 5) to help hold the support 76 in place.

In the operation of the present invention, to unload an auger assembly 20 onto the auger stand 10 of the present invention, the transport vehicle or tractor is moved into position with the auger shaft 62 located within the slot 18 and the auger hub 64 above the support plate 14. The assembly 20 may then be moved to any convenient position in the slot 18 of the support plate 14.

When the auger assembly 20 is moved into the desired place within the auger stand 10, the booms 66 are moved to lower the weight of the auger hub 64 onto the support plate 14. The support 76 is then positioned on the support plates 74 below booms 66 of the auger assembly 20.

With the auger assembly 20 in place and the support member 76 below and near the booms 66, the mechanism 56 is then operated. The handles 90 are manually turned, and the screws 82 move, raising the support plates 74 upwardly. The support member 76 is thus raised until it engages and supports the booms 66. The weight of the auger 20 is now transferred to and borne by the auger stand 10. The connector key or pin in the slot 70 is easily removable. It is to be noted that a user of the apparatus of the present invention is not required to support the weight of the auger assembly 20 during this operation. The foregoing procedure is performed in reverse order to remove the auger assembly from the stand 10.

Finally, an additional embodiment of the invention may be made by employing a slot 92 having a nonuniform width. Specifically, the slot 92 may feature a width which gradually narrows with increasing distance from the forward edge 94 of the support 14. This gradually narrowing or tapering width of slot 92 may be formed integrally in the support plate 14 or by the appropriate placement of the slot adjustment plates 96 to provide a narrow slot in rear portions of the plate 14 for added support of the auger hub 64 and a relatively wide or large entry in slot 92 for entry and passage of the auger shaft 62.

Having described the invention above, various modifications of the techniques, procedures, material and equipment will be apparent to those in the art. It is intended that all such variations within the scope and spirit of the appended claims be embraced thereby.

I claim:

1. An auger stand for an auger assembly, said auger assembly having a hub, an auger extending beneath the hub, a boom extending outwardly from the hub, and a drive shaft, said auger stand comprising:

(a) a rack comprised of a set of front and rear posts connected by support rods and forming a support frame having an opening for receiving the auger;

(b) a support plate member mounted on said support rods proximate the top of said rear posts of said rack and extending laterally across said opening and adapted to fit beneath said auger hub;

(c) said support plate member having an upper surface extending across said opening adapted to receive said auger hub to rest thereon;

(d) said support plate member having a slot extending downwardly therethrough for said auger to extend downwardly from said auger hub through said support plate member; and (e) coupling assembly connected to said rack forward of said front posts and said support plate member, said coupling assembly comprising a transverse support beam extending across said opening in said support frame for receiving said auger boom thereon and supporting said boom during mounting and dismounting of said auger assembly from a vehicle.

2. The auger stand of claim 1, wherein said coupling assembly further includes an elevating means for raising and lowering said transverse support beam.

3. The auger stand of claim 2, wherein said elevating means comprises a plurality of vertical members, each of said vertical members fitted with a movable mount for receiving said transverse support beam.

4. The auger stand of claim 3, wherein said elevating means further comprises a plurality of screw assemblies, each fitted to one of said vertical members, for raising and lowering said movable mount.

5. The auger stand of claim 3, wherein at least one of said mounts further comprises a stop lip.

6. The auger stand of claim 1, further comprising a slot adjustment means for changing the width of said slot extending through said support plate member.

7. The auger stand of claim 6, wherein said slot adjustment means comprises one or more plates secured to said support.

8. The auger stand of claim 7, wherein one or more of said one or more plates is adjustably secured to said support.

9. The auger stand of claim 7, wherein at least one of said one or more plates further comprises a stop lip.

10. The auger stand of claim 1, wherein said support further comprises a stop lip.

11. The auger stand of claim 1, wherein said slot in support plate member has a variable width, gradually narrowing with increasing distance to a base of said slot.

12. The auger stand of claim 1, further comprising an auxiliary support assembly connected to said front posts of said support frame of said rack and having a surface receiving said auger drive shaft for support of said auger drive shaft.

13. The auger stand of claim 12, wherein said auxiliary support assembly comprises a support member supported by a plurality of mounts connected to front posts of said support frame of said rack.

14. An auger stand for supporting a drilling auger, which is connectable by a connector linkage and a drive shaft to a transport vehicle, said auger having an auger blade extending about an auger shaft below an auger hub, said auger stand supporting the auger and the connector linkage during connection and disconnection of the connector linkage from the vehicle and comprising:

(a) a support rack comprised of a set of front and rear posts connected by support rods and forming a support frame having an opening for receiving the auger;

(b) a support plate member mounted on said support rods proximate the tops of said rear posts of said support rack and extending laterally across said opening and adapted to fit beneath the auger hub for receiving and supporting the auger hub thereon;

(c) said support plate member having an upper surface extending across said opening adapted to receive said auger hub to rest thereon;

(d) said support plate member having a slot formed extending downwardly therethrough for passage of the auger shaft therethrough and for guiding the auger hub into place on said support plate member; and (e) a transverse load transfer support beam adjustably mounted on said front posts of said support rack and forward of said support plate member and adapted to be positioned below and receive thereon the auger connector linkage to transfer the weight of the connector linkage to the stand.

15. The auger stand of claim 14, further including an elevating means for raising and lowering said transverse toad transfer support beam.

16. The auger stand of claim 15, wherein said elevating means comprises a plurality of vertical members, each of said vertical members fitted with a movable mount.

17. The auger stand of claim 16, wherein said elevating means further comprises a plurality of screw assemblies, each fitted to one of said vertical members, for raising and lowering said movable mount.

18. The auger stand of claim 16, wherein at least one of said mounts further comprises a stop lip.

19. The auger stand of claim 14, further comprising a slot adjustment means for changing the width of said slot extending through said support plate member.

20. The auger stand of claim 19, wherein said slot adjustment means comprises one or more plates secured to said support plate member.

21. The auger stand of claim 20, wherein one or more of said one or more plates is adjustably secured to said support plate member.

22. The auger stand of claim 20, wherein at least one of said one or more plates further comprises a stop lip.

23. The auger stand of claim 14, wherein said support plate member further comprises a stop lip.

24. The auger stand of claim 14, wherein said slot in said support plate member has a variable width, gradually narrowing with increasing distance to a base of said slot.

25. The auger stand of claim 14, further comprising an auxiliary support assembly connected to said front posts of said support frame of said rack and having a surface receiving said auger drive shaft for support of the auger drive shaft.

26. The auger stand of claim 25, wherein said auxiliary support assembly comprises a support member supported by a plurality of mounts connected to front posts of said support frame of said rack.

* * * * *

UNITED STATES PATENT AND TRADEMARK OFFICE

CERTIFICATE OF CORRECTION

PATENT NO. : 5,586,743

DATED : December 24, 1996

INVENTOR(S) : Eddie A. Sodolak

It is certified that error appears in the above-identified patent and that said Letters Patent is hereby corrected as shown below:

Claim 15, Column 6, line 19, please delete "toad" and insert --load--.

Signed and Sealed this

Eighth Day of April, 1997

Bruce Lehman

*Attest:*

BRUCE LEHMAN

*Attesting Officer*

*Commissioner of Patents and Trademarks*